United States Patent [19]

Wolens et al.

[11] Patent Number: 4,736,278

[45] Date of Patent: Apr. 5, 1988

[54] LIGHTING FIXTURE WITH ROTATING SUPPORT

[75] Inventors: John Wolens, 1000 N. Lake Shore Dr., Chicago, Ill. 60611; Nancy P. McGee, North Riverside, Ill.

[73] Assignee: John Wolens, Chicago, Ill.

[21] Appl. No.: 858,803

[22] Filed: May 2, 1986

[51] Int. Cl.[4] ..... F21V 21/30

[52] U.S. Cl. ..... 362/35; 362/124; 362/410; 362/806

[58] Field of Search ..... 362/35, 269, 319, 322, 362/806, 811, 410, 124; 40/409, 414, 429, 430, 431, 456, 474, 480

[56] References Cited

U.S. PATENT DOCUMENTS

| | | | |
|---|---|---|---|
| 2,772,348 | 11/1956 | Moss | 362/124 |
| 3,711,695 | 1/1973 | Orbach | 362/410 X |
| 3,793,755 | 2/1974 | Gersch et al. | 362/35 X |
| 3,885,797 | 5/1975 | Booty et al. | 362/35 X |
| 4,250,537 | 2/1981 | Roegner et al. | 362/811 X |
| 4,509,105 | 4/1985 | Short | 362/806 X |

FOREIGN PATENT DOCUMENTS

| | | | |
|---|---|---|---|
| 2617426 | 11/1977 | Fed. Rep. of Germany | 362/806 |

*Primary Examiner*—Margaret A. Focarino
*Attorney, Agent, or Firm*—Niro, Scavone, Haller & Niro, Ltd.

[57] ABSTRACT

A lighting fixture having a base, a cantilevered arm extending from the base and supporting a light, a rotatable platform, a motor for rotating the platform and electrical circuitry for actuating the light and/or the motor.

2 Claims, 1 Drawing Sheet

FIG. 1
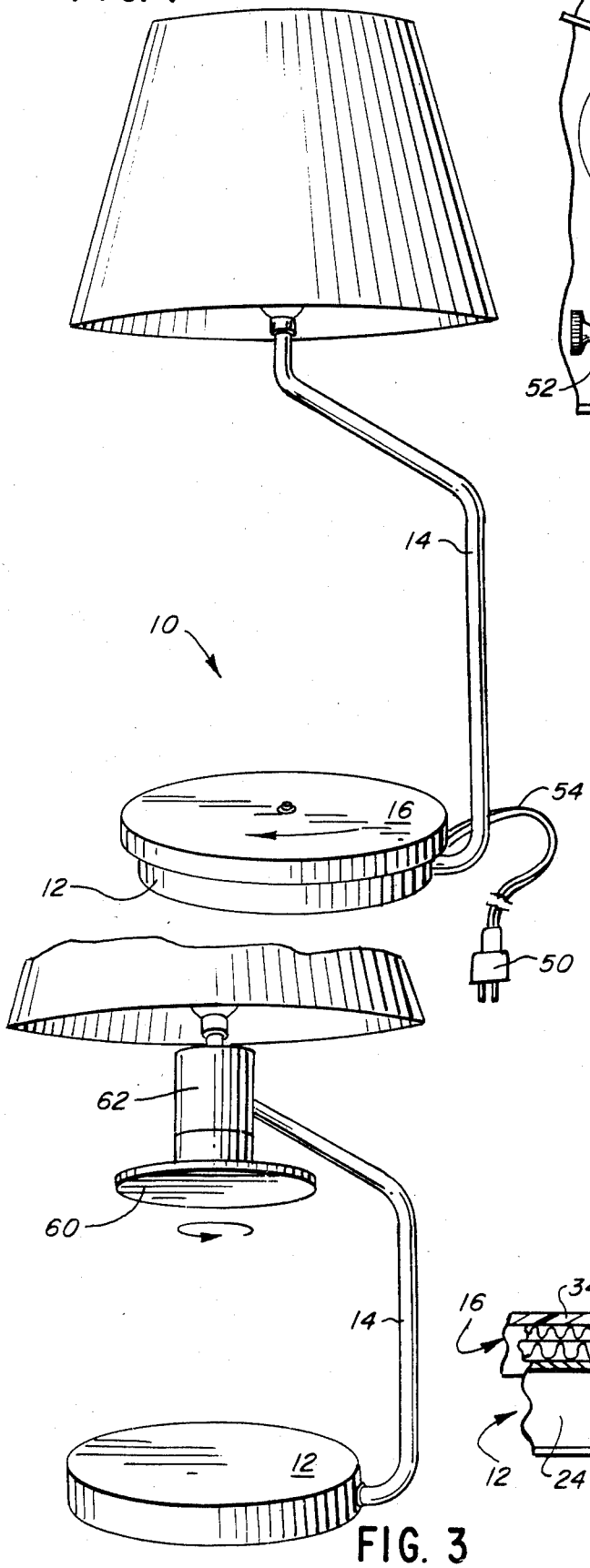
FIG. 2
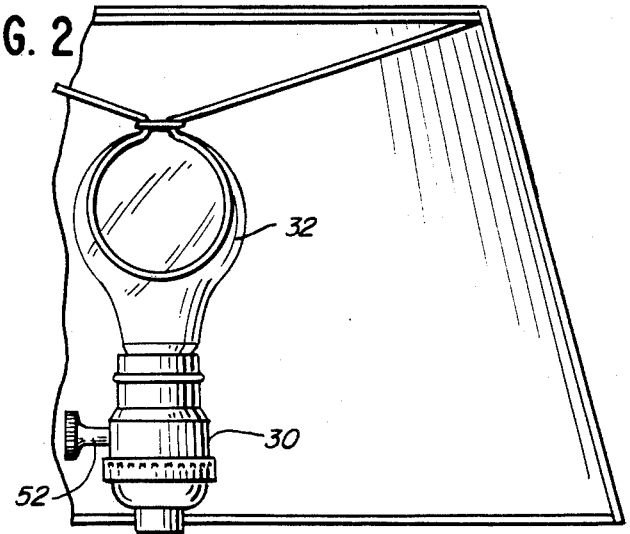
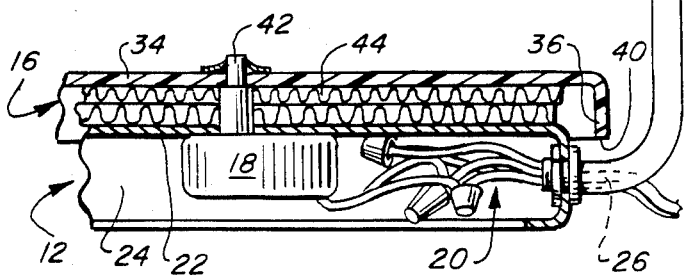
FIG. 3

LIGHTING FIXTURE WITH ROTATING SUPPORT

The present invention is directed to a unique lighting fixture having means for rotationally supporting display items. The invention finds particular application as a children's lamp wherein various decorative items may be mounted to enhance the appearance or attractiveness of the lamp.

In accordance with the present invention, an improved lighting fixture is provided which includes a base, a cantilevered arm for supporting a light, a rotatable platform, a motor for driving the platform, and an electrical circuit for selectively energizing either the light or the platform, or both the light and the platform.

In one preferred embodiment, the platform is mounted immediately above the base with the motor housed within the base.

In a second preferred embodiment, the platform is suspended above the base with the motor located within a housing. In this embodiment, the arm supports not only the light, but the platform and motor as well.

BRIEF DESCRIPTION OF THE DRAWINGS

The novel features of the invention are set forth in the appended claims. The invention itself, however, together with further objects and attendant advantages thereof, will be best understood by reference to the following description taken in connection with the accompanying drawings in which:

FIG. 1 is a perspective view of a lighting fixture of the present invention;

FIG. 2 is a partial cross-sectional view of the lighting fixture depicted in FIG. 1; and FIG. 3 is a partial perspective view of another preferred embodiment of the invention.

DETAILED DESCRIPTION OF THE PREFERRED EMBODIMENTS

Referring to FIGS. 1 and 2, a lighting fixture, designated generally as 10, is shown having a base 12, an arm 14, a platform 16, a motor 18 and electrical circuitry 20.

The base 12 is preferably cylindrical with a top 22 and sidewall 24, and may be fabricated from metal, plastic or other commonly employed materials. The arm 14 is a tubular form and is affixed at its proximal segment 26 to sidewall 24 by conventional means. Proximal segment 26 extends horizontally from the base 12 and into a generally vertical distal segment 28 of the arm which supports and electrical receptacle 30 and light element 32.

The platform 16 is preferably circular with a diameter slightly greater than that of the base 12 such that its support surface 34 extends radially beyond the perimeter of the base 12. The platform also includes a side flange 36 which depends from the support surface 34 and terminates at a lower edge 40. Edge 40 is positioned at a point below the top 22 of base 12 but above the proximal segment 26 of the arm 14. Preferably, side flange 36 and side wall 24 are concentric and closely adjacent one another to prevent inadvertent insertion of fingers or other objects into the space between the base and platform.

The motor 18 is a low rpm variety, preferably from 1 to 10 rpm, and is housed within the base 12 such that its drive shaft 42 extends through the top 22 and into driving connection with the platform 16.

One or more spacers 44 may also be employed to separate the platform 16 from base 12.

The electrical circuitry includes a plug 50, a switch 52 and insulated electrical conductors 54 extending from the plug to the motor 18, switch 52 and electrical receptacle 30. Preferably, the switch is a four position type to permit (1) an "off" or open circuit, (2) energizing the light element alone, (3) energizing the motor alone or (4) energizing both the light element and motor together.

Referring to FIG. 3, an alternative embodiment is shown wherein a platform 60 is suspended from a housing 62 which encloses the motor. Both the housing 62 and platform are supported by the distal segment 28 of the arm 14 at a point generally centrally located above base 12.

The purpose of the rotating platform in either embodiment is to support items to be displayed, such as figurines, cartoon characters, geometric shapes, etc.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

We claim:

1. A lighting fixture comprising:

a cylindrical base having a top and a sidewall;

a cantilevered arm mounted to the sidewall of said base and having a proximal segment extending in a generally horizontal orientation from said base and a distal generally vertical segment supporting a light element;

a rotatable platform mounted above said base, said platform having a generally planar support surface extending radially beyond the perimeter of said base and a depending side flange terminating at a lower edge located below the top of said base and above the proximal segment of said arm, said base sidewall and said platform side flange being disposed concentrically and closely adjacent one another;

a motor housed within said base in driving engagement with a shaft extending through the top of said base and fixed to said platform; and electrical circuit means for supplying current to said motor or said light element or both said motor and said light element.

2. The lighting fixture of claim 1 wherein said base and platform are separated by a low friction spacer.

* * * * *